US011660254B2

(12) United States Patent
Guo et al.

(10) Patent No.: US 11,660,254 B2
(45) Date of Patent: May 30, 2023

(54) PILL ORGANIZER

(71) Applicant: ZHUHAI QUIN TECHNOLOGY CO., LTD., ZHUHAI (CN)

(72) Inventors: Jinpeng Guo, Zhuhai (CN); Wei Du, Zhuhai (CN)

(73) Assignee: ZHUHAI QUIN TECHNOLOGY CO., LTD., Zhuhai (CN)

( * ) Notice: Subject to any disclaimer, the term of this patent is extended or adjusted under 35 U.S.C. 154(b) by 262 days.

(21) Appl. No.: 16/878,647

(22) Filed: May 20, 2020

(65) Prior Publication Data

US 2021/0283018 A1 Sep. 16, 2021

(30) Foreign Application Priority Data

Mar. 10, 2020 (CN) ..... 202020286174.X

(51) Int. Cl.
*A61J 7/00* (2006.01)
*A61J 1/03* (2023.01)

(52) U.S. Cl.
CPC ..... *A61J 7/0084* (2013.01); *A61J 1/03* (2013.01)

(58) Field of Classification Search
CPC ..... B65D 47/0871
See application file for complete search history.

(56) References Cited

U.S. PATENT DOCUMENTS 6,371,321 B1 * 4/2002 Lee ..... B65D 43/22 220/23.6
10,420,703 B1 * 9/2019 Lee ..... A61J 7/0084
2006/0096984 A1 * 5/2006 Bandoh ..... B65D 83/08 220/264
2007/0278227 A1 * 12/2007 Damaghi ..... B65D 43/164 220/254.5
2009/0166243 A1 * 7/2009 Cetera ..... A61J 1/03 206/459.5
2011/0309099 A1 * 12/2011 Bandoh ..... B65D 83/0805 220/849

* cited by examiner

*Primary Examiner* — Mollie Impink

(57) ABSTRACT

The present disclosure provides a pill organizer. The pill organizer comprises a box body. The box body comprises at least one pill storage cavity and at least one cover. The pill storage cavity defining an upper end opening. The cover is matched with the upper end opening and is disposed on the upper end opening of the pill storage cavity. One end of the cover is rotatably connected with the box body. Another end of the cover is detachably buckled with the box body. An elastic piece is disposed om an inner surface of the one end of the cover rotatably connected with the box body. One end of the elastic piece is fixed on the box body. Another end of the elastic piece of the covers is buckled with one side of the pill storage cavity of the box body.

8 Claims, 5 Drawing Sheets

PILL ORGANIZER

CROSS-REFERENCE TO RELATED APPLICATION

The present application claims foreign priority to Chinese Patent Application No. CN202020286174.X, titled "PILL ORGANIZER WITH BUCKLED ELASTIC PIECE," filed on Mar. 10, 2020 in the State Intellectual Property Office of China, and the entire contents of which is hereby incorporated by reference.

TECHNICAL FIELD

The present disclosure relates to a field of pill boxes, and in particular to a pill organizer with a buckled elastic piece.

BACKGROUND

A pill box on the market generally comprises an upper cover and a main body. The upper cover of the pill box is integrally connected with the main body of the pill box. And when the upper cover is in a closed position, the upper cover is deformed and bent. When unlocking the upper cover, the upper cover is automatically opened by force generated by deformation of the upper cover. However, due to high strength of the upper cover, deformation recovery of the upper cover is small, resulting in that the upper cover cannot be fully opened automatically, and require users to open the upper cover manually, which is inconvenient for the users to take out or replenish pills. In addition, since the pill box is closed most of the time and the upper cover is deformed and bent at the closed position for a long time, the upper cover is easily damaged, which greatly shorten service life of the pill box, and also affect sealing property of the pill box.

SUMMARY

In order to solve above problems in the prior art, the present disclosure provides a pill organizer with a buckled elastic piece. A cover of the pill organizer with a buckled elastic piece is able to be fully opened automatically, which is convenient to take out and replenish pills, and simple and fast in operation. Moreover, when the cover is in a closed state, a sealing effect of the pill organizer with the buckled elastic piece is stable and reliable, and a service life is long. Further, the pill organizer with the buckled elastic piece has ingenious and compact structure, which is quick and convenient to assemble, and is easy to produce.

To achieve the above objection, the present disclosure provides a pill organizer. The pill organizer comprises a box body. The box body comprises at least one pill storage cavity and at least one cover. The pill storage cavity defining an upper end opening. The cover is matched with the upper end opening and is disposed on the upper end opening of the pill storage cavity. One end of the cover is rotatably connected with the box body. Another end of the cover is detachably buckled with the box body. An elastic piece is disposed om an inner surface of the one end of the cover rotatably connected with the box body. One end of the elastic piece is fixed on the box body. Another end of the elastic piece of the covers is buckled with one side of the pill storage cavity of the box body.

Furthermore, an upper edge of one side wall of the pill storage cavity has a notch. Another end of the elastic piece of the cover is buckled with the notch.

Furthermore, a clamping seat is disposed on a rear end of an inner surface of the cover. An engaging hole is disposed on the clamping seat. The elastic piece is an S-shaped elastic piece or an L-shaped elastic piece. The one end of the elastic piece comprises an inverse clamping head. And the another end of the elastic piece comprises a curved buckling portion. During assembly, the curved buckling portion passes through the engaging hole and hooks on an edge of the engaging hole, and the curved buckling portion is buckled with the notch.

Furthermore, the clamping seat and is integrated together with the cover. The inverse clamping head and the curved buckling portion are integrated together with the elastic piece.

Furthermore, the elastic piece is an elastic plastic piece or an elastic metal piece.

Furthermore, an rear end of the cover is rotatably connected with an rear end of the pill storage cavity of the box body. A front end of the cover is detachably, buckled with a front end of the pill storage cavity of the box body. The one end of the elastic piece is fixed on an inner surface of the rear end of the cover. The another end of the elastic piece is buckled with the rear end of the pill storage cavity of he box body.

Furthermore, a locking buckle matched with the pill storage cavity is disposed on a front end of the box body. A buckle hole is disposed on the front end of the cover. The buckle hole of the cover is buckled with the locking buckle when the cover is closed.

Furthermore, the box body comprises at least one row of pill storage cavities arranged side by side along a longitudinal direction of the box body.

Furthermore, the box body is assembled from more than one pill box bodies. Two adjacent pill body bodies are connected by magnetic attraction. Each of the pill box bodies comprises the at least one pill storage cavity defining the upper end opening and at least one cover.

The cover of the pill organizer of the present disclosure is able to be fully opened automatically, which is convenient to take out and replenish pills, and is simple and fast in operation. Moreover, when the cover is in a closed state, the sealing effect of the pill organizer is stable and reliable, and a service life is long. Further, the pill organizer has an ingenious and compact structure, which is quick and convenient to assemble, is easy to produce, and is conducive to mass production and popularization.

DETAILED DESCRIPTION

Figure 1:
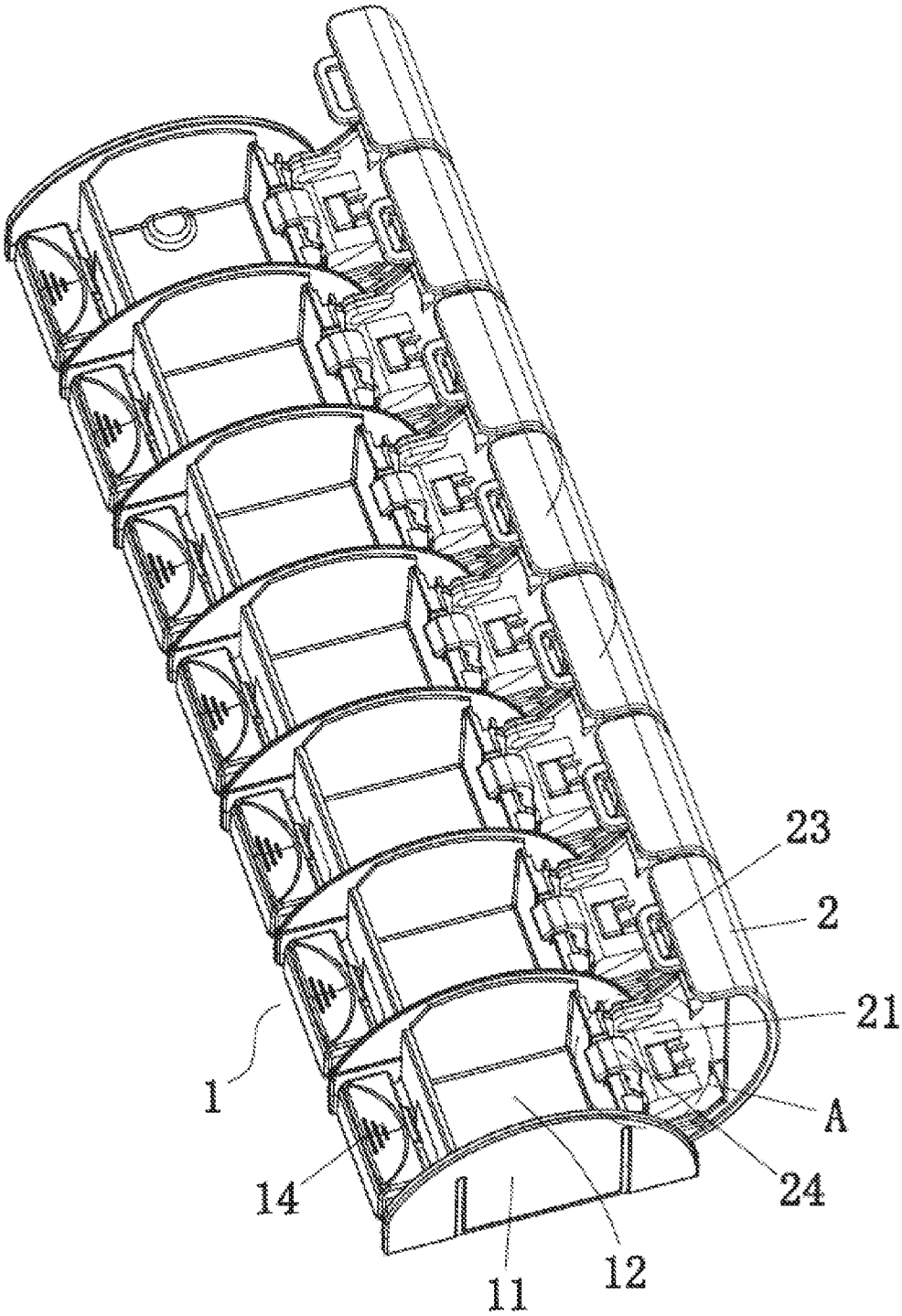
FIG. 1 is a schematic diagram showing a structure of a pill organizer according to a first embodiment of the present disclosure.

In order to make the purpose, technical solutions and advantages of the present disclosure more clear, the present disclosure will be described in further detail below with reference to the accompanying drawings and embodiments. It should be understood that the specific embodiments described below are only used to explain the present disclosure, and are not intended to limit the present disclosure.

As shown in FIGS. 1-5, a first embodiment and a second embodiment of the present disclosure provides a pill organizer with a buckled elastic piece. The pill organizer comprises a box body 1. The box body 1 comprises at least one pill storage cavity 12 and at least one cover 2. The pill storage cavity 12 defines an upper end opening. The cover 2 is matched with the upper end opening and is disposed on the upper end opening of the pill storage cavity 12. One end of the cover 2 is rotatably connected with the box body 1. Another end of the cover 2 is detachably buckled with the box body 1. An elastic piece 24 is disposed om an inner surface of the one end of the cover 2 rotatably connected with the box body 1. One end of the elastic piece 24 is fixed on the box body 1. Another end of the elastic piece 24 of the cover 2 is buckled with one side of the pill storage cavity 12 of the box body 1.

Specifically, the box body 1 comprises at least one row of pill storage cavities 12 arranged side by side along a longitudinal direction of the box body 1. Covers 2 are one to one arranged on pill storage cavities 12. An rear end of each cover 2 is rotatably connected with an rear end of each pill storage cavity 12 of the box body 1. A front end of each cover 2 is detachably buckled with a front end of each pill storage cavity 12 of the box body 1. The one end of each elastic piece 24 is fixed on an inner surface of the rear end of each cover 2. The another end of each elastic piece 24 is buckled with the rear end of each pill storage cavity 12 of he box body 1.

Figure 2:
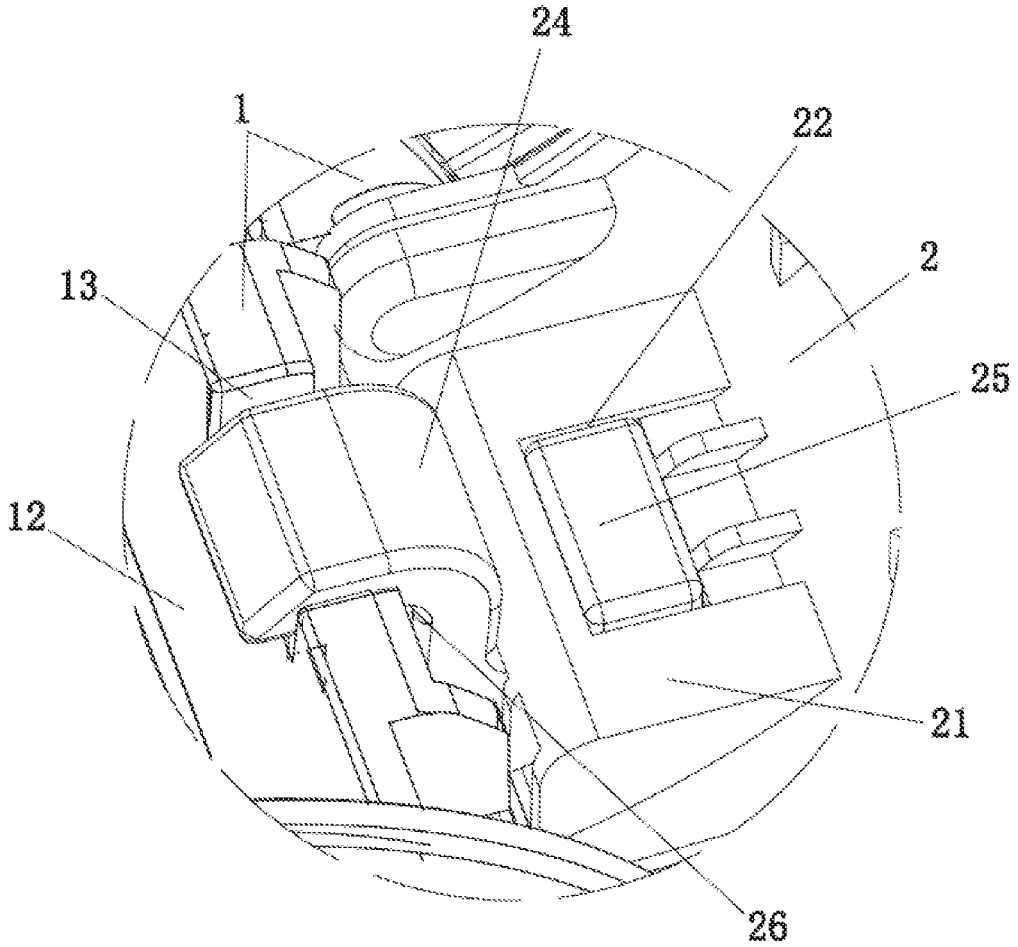
FIG. 2 is an enlarged schematic structural view of portion A shown in FIG. 1.
Figure 3:
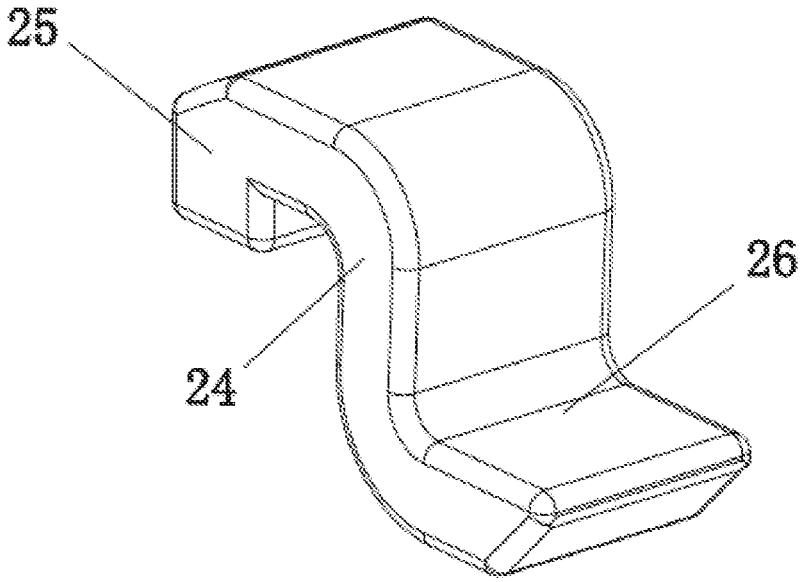
FIG. 3 is a schematic diagram showing a structure of an elastic piece of the pill organizer according to the first embodiment of the present disclosure.
Figure 5:
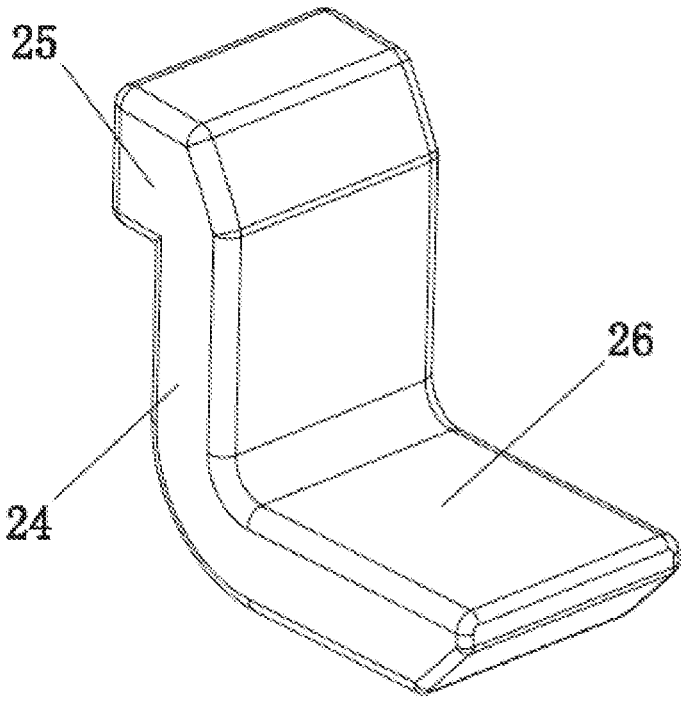
FIG. 5 is a schematic diagram showing a structure of an elastic piece of a pill organizer according to the second embodiment of the present disclosure.

As shown in FIGS. 1-2, a clamping seat 21 is disposed on a rear end of an inner surface of each cover 2. An engaging hole 22 is disposed on each clamping seat 21. Each clamping seat 21 is integrated together with each cover 2 (e.g., each clamping seat 21 and each cover 2 are integrally injection molded). As shown in FIGS. 3 and 5, each elastic piece 24 is an S-shaped elastic piece or an L-shaped elastic piece. The one end of each elastic piece 24 comprises an inverse clamping head. And the another end of each elastic piece 24 comprises a curved buckling portion 26. Each elastic piece 24 is selected from an elastic plastic piece. Each inverse clamping head 25 and each curved buckling portion 26 are integrated together with each elastic piece 24 (e.g., the inverse clamping head 25 and the curved buckling portion 26 of each elastic piece 24 are integrally injection molded using a silicone rubber material).

Figure 4:
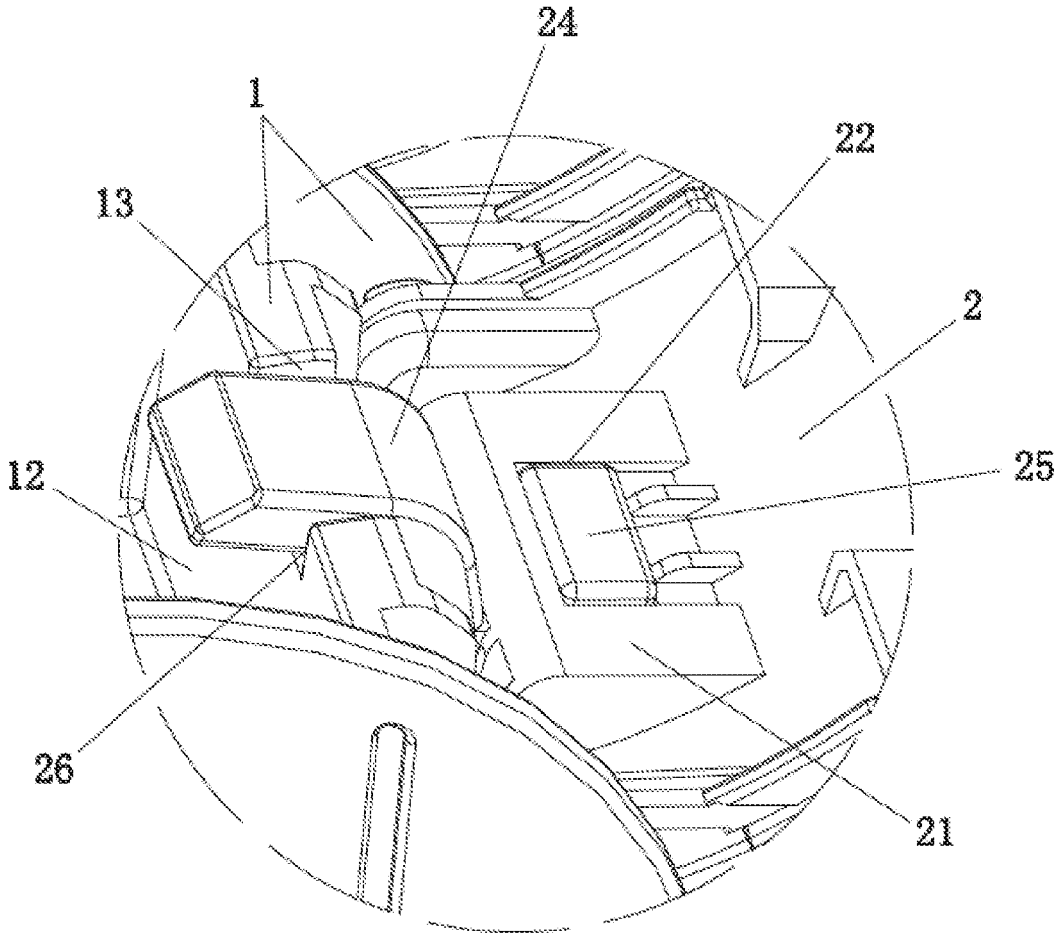
FIG. 4 is an enlarged schematic view of a partial structure of a pill organizer according to a second embodiment of the present disclosure.

An upper edge of one side wall of each pill storage cavity 12 has a notch 13. When assembly, as shown in FIGS. 1,2, and 4, each curved buckling portion 26 passes through each engaging hole 22 and hooks on an edge of each engaging hole 22, and another end of each elastic piece 24 is buckled with the notch 13, that is, the curved buckling portion 26 is buckled with the notch 13. A locking buckle 14 matched with each pill storage cavity 12 is disposed on a front end of the box body 1. A buckle hole 23 is disposed on the front end of each cover 2. Each buckle hole 23 of each cover 2 is buckled with each locking buckle 14 when each cover 2 is in a closed state.

In the present disclosure, when taking out or replenishing the pills, another end of each cover 2 is separated from the box body 1, that is, each locking buckle 14 disposed on the front end of the box body 1 is controlled to separate from each buckle hole 23 disposed on the front end of each cover 2. At the moment of separation, each elastic piece 24 deformed by squeezing is restored, so that each cover 2 is automatically turned up to be fully opened. After taking out or replenishing the pills, each cover 2 is controlled to move downwardly until each cover 2 is buckled with the box body 1 (e. g., each buckle hole 23 at the front of each cover 2 is snapped into each locking buckle 14). At this time, each elastic piece 24 is squeezed by each cover 2 and deformed.

By providing each elastic piece 24 on each cover 2 of the pill organizer, each cover 2 of the pill organizer of the present disclosure is able to be fully opened automatically, which is convenient to take out and replenish pills, and is simple and fast in operation. Moreover, when the cover 2 is in a closed state, the sealing effect of the pill organizer is stable and reliable, and a service life is long. Further, the pill organizer has an ingenious and compact structure, which is quick and convenient to assemble, is easy to produce, and is conducive to mass production and popularization.

Of course, the box body is assembled from more than one pill box bodies. For example, two adjacent pill box bodies 11 are connected by magnetic attraction. In this embodiment, two adjacent pill box bodies 11 are connected together by a magnetic connecting piece provided on one side of pill box bodies. Or, in another embodiment, the two adjacent pill box bodies 11 are assembled together through a clamping hole disposed on one side and a clamping pin disposed on the other side of the pill box bodies 11. However, the present disclosure is not limited thereto.

In one embodiment, each of the pill box bodies 11 comprises the at least one pill storage cavity defining the upper end opening and at least one cover. In this way, the users are able to arbitrarily combine the pill box bodies 11 according to different usage situations, which is more convenient to use and carry. In addition, each elastic piece 24 is also able to be selected from an elastic metal piece, such as a metal dome.

The above are some optional embodiments of the present disclosure. It should be understood that for those ordinary skilled in the art, without departing from the principles of the present disclosure, several improvements and retouches can be made, which is also regarded as within the protection scope of the present disclosure.

What is claimed is:

1. A pill organizer, comprising a box body; wherein the box body comprises at least one pill storage cavity and at least one cover; the pill storage cavity defines an upper end opening; the cover is matched with and disposed on the upper end opening; one end of the cover is rotatably connected with the box body; another end of the cover is detachably buckled with the box body; wherein an elastic piece is disposed on an inner surface of the end of the cover rotatably connected with the box body; wherein one end of the elastic piece is fixed to the cover; another end of the elastic piece is interlocked with a general side area of the pill storage cavity of the box body;

wherein a notch is defined in an upper edge of a vertical back wall of the pill storage cavity; and one other end of the elastic piece is interlocked with the notch;

wherein a clamping seat is disposed on a rear end of the inner surface of the cover; and an engaging hole is defined in the clamping seat, wherein the engaging hole is a through hole; the elastic piece is an S-shaped elastic piece; wherein the end of the elastic piece connected to the cover comprises a bent end portion, and the end of the elastic piece interlocked with the notch comprises a curved buckling portion; when assembled, the bent end portion passes through the engaging hole and is hooked on an edge of the engaging hole, and wherein the curved buckling portion is inserted into and interlocked with the notch.

2. The pill organizer according to claim 1, wherein the clamping seat is integrally formed with the cover; the inverse clamping head bent end portion and the curved buckling portion of the elastic piece are integrally formed with each other.

3. The pill organizer according to claim 1, wherein the elastic piece is an elastic plastic piece or an elastic metal piece.

4. The pill organizer according to claim 1, wherein a rear end of the cover is rotatably connected with a rear end of the pill storage cavity of the box body; a front end of the cover is detachably buckled with a front end of the pill storage cavity of the box body; the end of the elastic piece fixed to the cover is fixed to an inner surface of the rear end of the cover.

5. The pill organizer according to claim 4, wherein a locking buckle matched with the pill storage cavity is disposed on a front end of the box body, and a buckle hole is defined in the front end of the cover; wherein the buckle hole of the cover is buckled with the locking buckle when the cover is closed.

6. The pill organizer according to claim 1, wherein the box body comprises at least one row of pill storage cavities arranged side by side along a longitudinal direction of the box body.

7. The pill organizer according to claim 1, wherein the box body is assembled from more than one pill box body; every two adjacent pill bodies are connected by magnetic attraction; each of the pill box bodies comprises the at least one pill storage cavity defining the upper end opening and at least one cover.

8. A pill organizer, comprising a box body; wherein the box body comprises at least one pill storage cavity and at least one cover; the pill storage cavity defines an upper end opening; the cover is matched with and disposed on the upper end opening; one end of the cover is rotatably connected with the box body; another end of the cover is detachably buckled with the box body; wherein an elastic piece is disposed on an inner surface of the end of the cover rotatably connected with the box body; wherein one end of the elastic piece is fixed to the cover; another end of the elastic piece is interlocked with a general side area of the pill storage cavity of the box body;

wherein a notch is defined in an upper edge of a vertical back wall of the pill storage cavity; and one other end of the elastic piece is interlocked with the notch;

wherein a clamping seat is disposed on a rear end of the inner surface of the cover; and an engaging hole is defined in the clamping seat; the elastic piece is an L-shaped elastic piece; wherein the end of the elastic piece connected to the cover comprises a bent end portion, and the end of the elastic piece interlocked with the notch comprises a curved buckling portion; when assembled, the bent end portion passes through the engaging hole and is hooked on an edge of the engaging hole, and wherein the curved buckling portion is interlocked with the notch.

* * * * *